US006071024A

United States Patent [19]

Chi-Ming et al.

[11] Patent Number: 6,071,024

[45] Date of Patent: Jun. 6, 2000

[54] INK RIBBON POSITIONING SYSTEM

[75] Inventors: Chien Chi-Ming, Yung-Ho; Chun-Jun Lee, Hsin-Ten; Yen-Chi Lee, Taichung Hsien, all of Taiwan

[73] Assignee: Acer Peripherals, Inc., Taoyuan, Taiwan

[21] Appl. No.: 09/163,322

[22] Filed: Sep. 30, 1998

[51] Int. Cl.[7] ..... B41J 2/315

[52] U.S. Cl. ..... 400/120.02; 347/177; 347/179

[58] Field of Search ..... 400/120.02, 124.02, 400/224.2, 216.1, 207 E, 208, 208.1; 347/177, 178, 172

[56] References Cited

U.S. PATENT DOCUMENTS

| | | | |
|---|---|---|---|
| Re. 33,260 | 7/1990 | Stephenson | 347/178 |
| 4,496,955 | 1/1985 | Maeyama et al. | 347/178 |
| 4,551,729 | 11/1985 | Kubo et al. | 347/178 |
| 4,573,059 | 2/1986 | Shinma et al. | 347/178 |
| 4,588,316 | 5/1986 | Everett, Jr. | 400/124.02 |
| 4,590,490 | 5/1986 | Takanashi et al. | 347/176 |
| 4,642,655 | 2/1987 | Sparer et al. | 347/178 |
| 4,710,781 | 12/1987 | Stephenson | 347/178 |
| 4,893,951 | 1/1990 | Iwatani et al. | 400/225 |
| 5,185,315 | 2/1993 | Sparer | 400/208 X |
| 5,266,968 | 11/1993 | Stephenson et al. | 400/208 X |
| 5,434,597 | 7/1995 | Muranaka et al. | 347/178 |
| 5,455,617 | 10/1995 | Stephenson et al. | 400/208.1 X |
| 5,466,075 | 11/1995 | Kouzai et al. | 400/120.02 X |
| 5,751,601 | 5/1998 | Tang et al. | 347/177 X |
| 5,781,219 | 7/1998 | Kouzai et al. | 347/178 |
| 5,820,274 | 10/1998 | Fukuoka et al. | 400/120.02 |

*Primary Examiner*—Edgar Burr
*Assistant Examiner*—Minh H. Chau
*Attorney, Agent, or Firm*—Winston Hsu

[57] ABSTRACT

The present invention relates to an ink ribbon positioning system of a color printer for identifying a position of a color ink ribbon of the color printer. The ink ribbon is windingly installed inside an ink ribbon box comprising a plurality of dye blocks. Each of the dye blocks comprises a plurality of transparent color frames, and the color frames are used for storing different color dyes. The ink ribbon positioning system comprises a light source installed at one side of the ink ribbon for emitting a color light beam through the ink ribbon, an optical sensor for detecting the light beam and generating a corresponding output voltage, and an identification device for identifying positions of a dye block of the ink ribbon and color frames inside the dye block according to output voltages generated by the optical sensor and generating corresponding position signals. The color printer further comprises a thermal print head and a control circuit. The control circuit will control the printing of the thermal print head according to the position signals. The light beam of a predetermined color emitted by the light source has a different penetration rate through different frames of a dye block. When two adjacent color frames pass by the optical sensor in succession, the optical sensor will generate different output voltages, and the identification device will identify the positions of the dye block and the color frames inside the dye block according to the generated output voltages.

18 Claims, 5 Drawing Sheets

| frame color | output voltage (76) | position signal (78) |
|---|---|---|
| [redacted] | 0V | 000 |
| yellow | 4.7V | 111 |
| magenta | 2.7V | 011 |
| cyan | 1.7V | 001 |
| [redacted] | 0V | 000 |

| frame color | output voltage (84) | position signal (86) |
|---|---|---|
| [redacted] | 0V | 000 |
| yellow | 4.7V | 111 |
| magenta | 2.7V | 011 |
| cyan | 1.7V | 001 |
| protective material | 4.7V | 111 |
| [redacted] | 0V | 000 |

| frame color | output voltage | comparison signal (124) | time signal (126) |
|---|---|---|---|
| | 0V | 0 | S |
| yellow | 4.7V | 1 | L |
| magenta | 2.7V | 0 | L |
| transparent | 4.7V | 1 | S |
| cyan | 1.7V | 0 | L |
| transparent | 4.7V | 1 | S |
| | 0V | 0 | S |

FIG. 6A

| frame color | output voltage | comparison signal (128) | time signal (130) |
|---|---|---|---|
| | 0V | 0 | S |
| yellow | 4.7V | 1 | L |
| magenta | 2.7V | 0 | L |
| transparent | 4.7V | 1 | S |
| cyan | 1.7V | 0 | L |
| protective material (132) | 4.7V | 1 | L |
| | 0V | 0 | S |

FIG. 6B

| frame color | output voltage | comparison signal (134) | time signal (136) |
|---|---|---|---|
| yellow | 4.7V | 1 | L |
| magenta | 2.7V | 0 | L |
| transparent | 4.7V | 1 | S |
| cyan | 1.7V | 0 | L |

FIG. 6C

INK RIBBON POSITIONING SYSTEM

BACKGROUND OF THE INVENTION

1. Field of the Invention

The invention relates to an ink ribbon positioning system, and more particularly, to an ink ribbon positioning system for identifying various positions of a color ink ribbon of a color printer.

2. Description of the Prior Art

Please refer to FIG. 1. FIG. 1 is a perspective view of a prior art ink ribbon positioning system 10. The ink ribbon positioning system 10 is used for identifying the position of a color ink ribbon 11 of a color printer (not shown). The ink ribbon 11 is windingly installed inside a ribbon box (not shown), and comprises a plurality of dye blocks 12 arranged in a row. Each of the dye blocks 12 comprises three sequentially arranged transparent color frames 14, 16, 18 for placing yellow, magenta, and cyan dyes. The ink ribbon 11 further comprises a plurality of sequentially arranged strip areas 20, 22, 24 separately installed next to each of the color frames 14, 16, 18. The strip area 20 is an opaque area installed between the yellow and cyan color frames 14, 18. The strip area 22 has a top transparent portion and a bottom opaque portion and is installed between the yellow and magenta color frames 14, 16. The strip area 24 also has a top transparent portion and a bottom opaque portion and is installed between the magenta and cyan color frames 16, 18.

The ink ribbon positioning system 10 further comprises two light sources 26, 28 arranged along a vertical direction at one side of the ink ribbon 11, and two corresponding sensors 30, 32 installed at another side of the ink ribbon 11. The position of the ink ribbon 11 is identified through the strip areas 20, 22, 24. The detection of the strip area 20 by the sensors 30, 32 corresponds to the beginning of a new dye block 12 of the ink ribbon 11. The detection of the partially opaque area 22 or 24 by the sensors 30, 32 corresponds to the beginning of the magenta or cyan color frame 16, 18 of the ink ribbon 11. Because the ink ribbon positioning system 10 is installed with two sets of light sources 26, 28 and sensors 30, 32 for the detection of the position of the ink ribbon 11, it has a very high production cost.

SUMMARY OF THE INVENTION

It is therefore a primary objective of the present invention to provide an ink ribbon positioning system to solve the above mentioned problem.

Briefly, in a preferred embodiment, the present invention provides an ink ribbon positioning system of a color printer for identifying various positions of a color ink ribbon of the color printer and generating corresponding position signals, the color printer comprising a thermal print head and a control circuit which uses the position signals to control the printing of the thermal print head, the ink ribbon being windingly installed inside an ink ribbon box having a plurality of sequentially arranged dye blocks, each of the dye blocks comprising a predetermined number of sequentially arranged transparent color frames for storing different color dyes; the ink ribbon positioning system comprising:

a light source installed at one side of the ink ribbon for emitting a light beam of a predetermined color through the ink ribbon;

an optical sensor for detecting the light beam penetrated through the ink ribbon and generating an output voltage; and an identification device for identifying positions of each of the dye blocks of the ink ribbon and the color frames within each of the dye blocks according to the output voltage generated by the optical sensor and generating corresponding position signals;

wherein the light beam of the predetermined color emitted by the light source has different penetration rates for different color frames of each of the dye blocks, and the output voltage generated by the optical sensor varies when each of the color frames within each of the dye blocks pass by the optical sensor, and wherein the identification device identifies the position of each of the dye blocks and the position of each of the color frames within each dye block according to the output voltage of the optical sensor.

It is an advantage of the present invention that the ink ribbon positioning system only comprises a light source and an optical sensor. Thus, the number of components of the color printer is reduced and the production cost is lowered.

These and other objects and the advantages of the present invention will no doubt become obvious to those of ordinary skill in the art after having read the following detailed description of the preferred embodiment that is illustrated in the various figures and drawings.

BRIEF DESCRIPTION OF THE DRAWINGS

FIG. 6A shows comparison signals and time signals generated by the ink ribbon positioning system in FIG. 5.

FIG. 6B shows comparison signals and time signals generated by the ink ribbon positioning system in FIG. 5 through an alternative ink ribbon.

FIG. 6C shows comparison signals and time signals generated by the ink ribbon positioning system in FIG. 5 through another ink ribbon.

DETAILED DESCRIPTION OF THE PREFERRED EMBODIMENT

Figure 1:
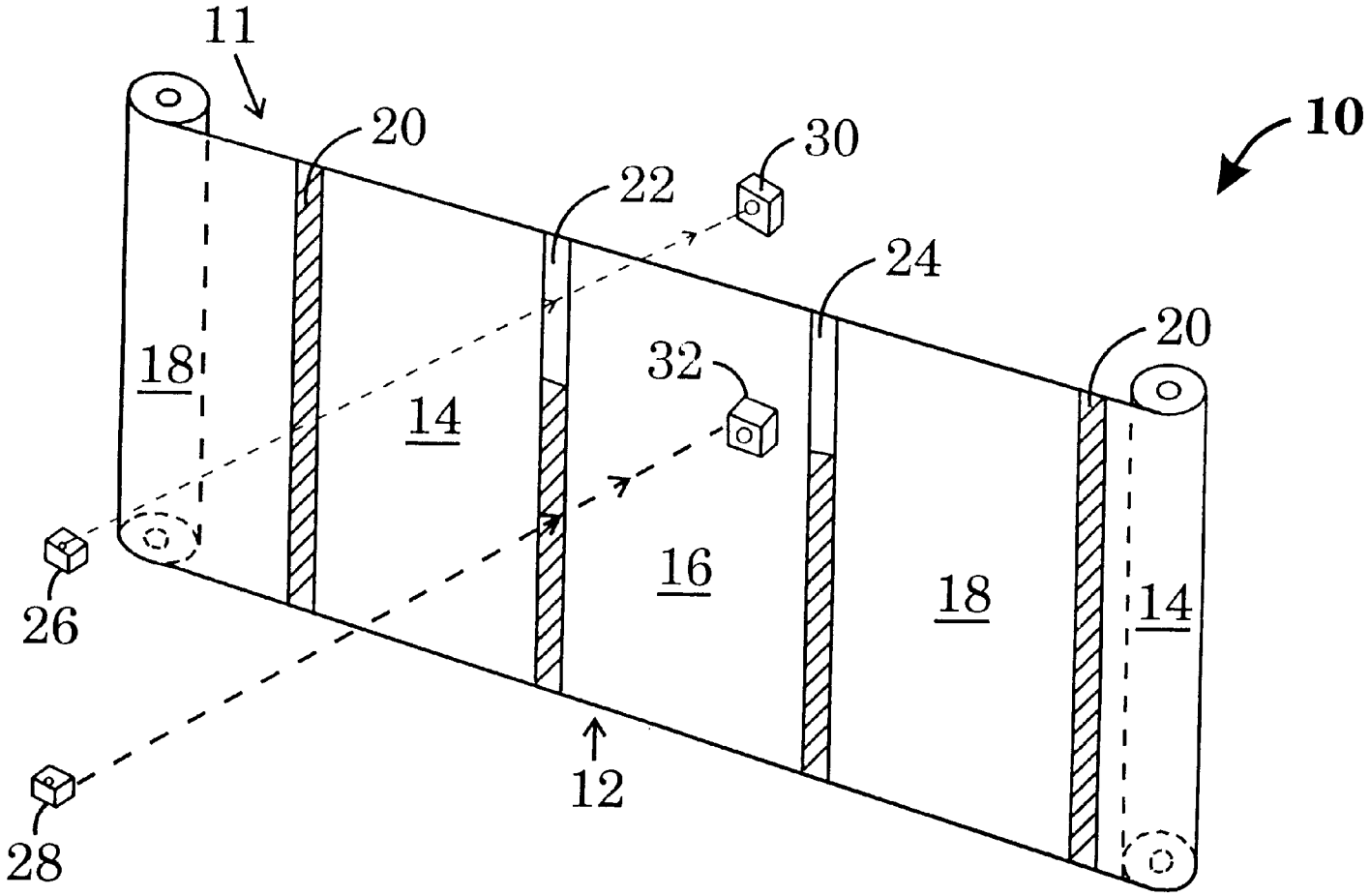
FIG. 1 Prior Art
FIG. 1 is a perspective view of a prior art ink ribbon positioning system.
Figure 2:
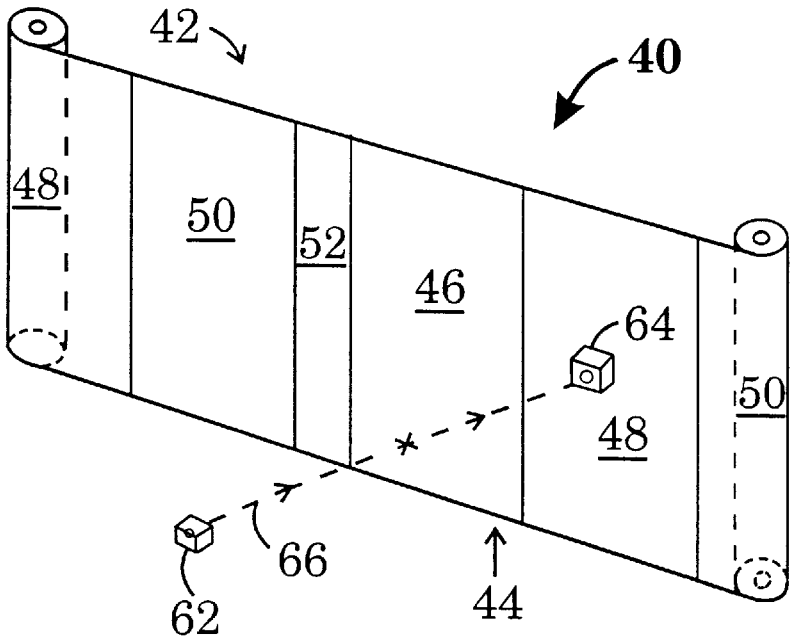
FIG. 2 is a perspective view of an ink ribbon positioning system according to the present invention.
Figure 3:
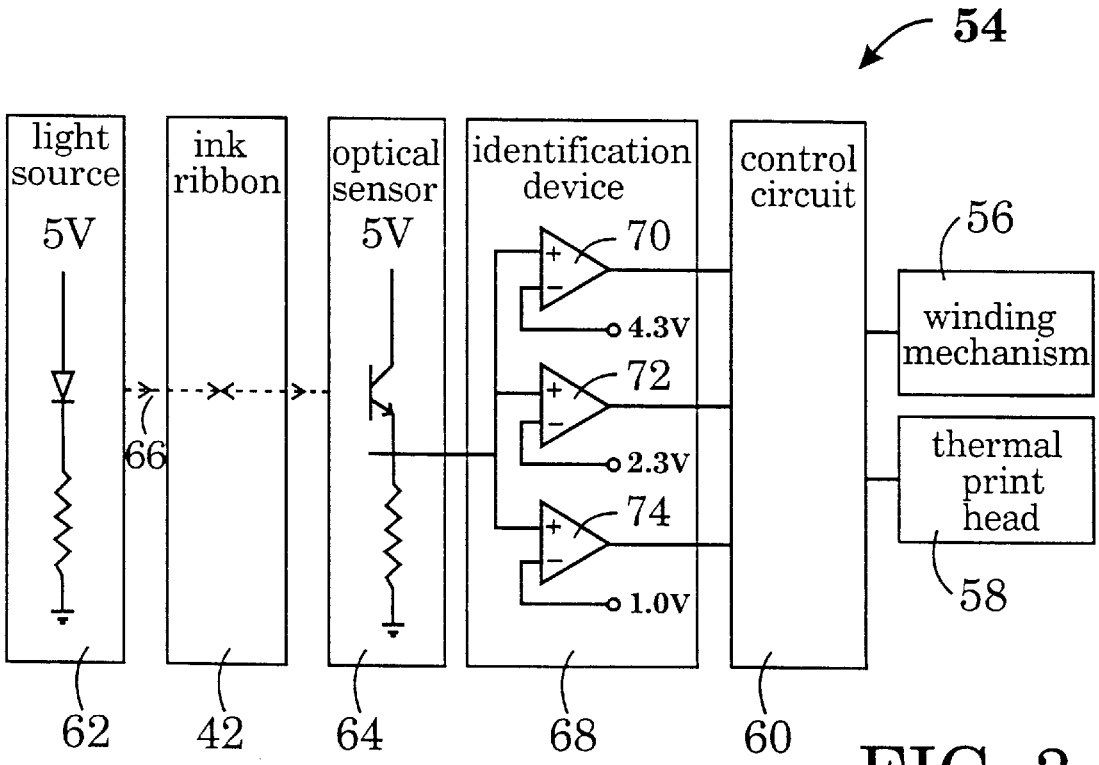
FIG. 3 is ablock diagram of the color printer in FIG. 2.

Please refer to FIGS. 2 and 3. FIG. 2 is a perspective view of an ink ribbon positioning system 40 according to the present invention. FIG. 3 is a block diagram of a color printer 54. The ink ribbon positioning system 40 is used for identifying the position of a color ink ribbon 42 of a thermal color printer 54. The ink ribbon 42 is installed inside a ribbon box (not shown) in a windable manner. It comprises a plurality of sequentially arranged dye blocks 44. Each of the dye blocks 44 comprises three sequentially arranged transparent color frames 46, 48, 50 for separately placing yellow, magenta, and cyan dyes. The ink ribbon 42 also comprises opaque areas 52 installed at the front and rear ends of the dye blocks 44.

The ink ribbon positioning system 40 comprises a light source 62 installed at one side of the ink ribbon 42 for emitting a light beam 66 of a predetermined color toward the ink ribbon 42, an optical sensor 64 installed at the opposite side of the ink ribbon 42 for detecting the light beam 66 passed through the ink ribbon 42 and generating a corresponding output voltage, and an identification device 68 for identifying positions of a dye block 44 of the ink ribbon 42 and color frames 46, 48, 50 inside the dye block 44 according to the output voltages generated by the optical sensor 64 and generating corresponding position signals. The light beam 66 emitted by the light source 62 has different penetration rates for the three color frames 46, 48, 50 inside a dye block 44 and the opaque area 52. Therefore, when two adjacent color frames pass by the optical sensor 64, the optical sensor 64 will generate different voltages.

The color printer 54 comprises a winding mechanism 56 for winding the ink ribbon 42 inside the ribbon box so that each of the color frames 46, 48, 50 inside a dye block 44 pass by a thermal print head 58 sequentially, a thermal print head 58 for printing the dyes on the color frames 46, 48, 50 onto paper (not shown) sequentially, and a control circuit 60 for controlling operations of the winding mechanism 56 and the thermal print head 58 according to position signals generated by the identification device 68 so as to print the color image.

Because the light beam 66 emitted by the light source 62 has different penetration rates for different color frames 46, 48, 50 and the opaque area 52, as two adjacent color frames pass by the optical sensor 64 in sequence, the optical sensor 64 will generate different voltages. The identification device 68 will identify the positions of the dye block 44 and the color frames 46, 48, 50 inside the dye block 44 according to their corresponding output voltages generated by the optical sensor 64, and will generate corresponding position signals. The control circuit 60 will control the winding mechanism 56 to wind the ink ribbon 42 according to the position signals generated by the identification device 68 so as to pass the ink ribbon 42 by the thermal print head 58 for sequentially printing dyes onto the paper.

Figures 4, 4A, 4B:
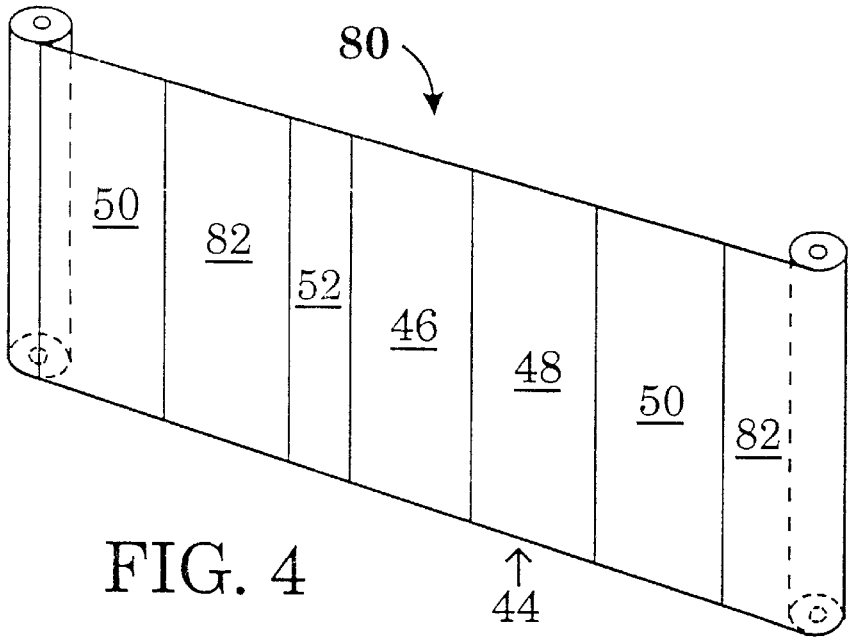
FIG. 4 is a perspective view of another ink ribbon according to the present invention.
FIG. 4A shows position signals generated by the identification device through the ink ribbon in FIG. 2.
FIG. 4B shows position signals generated by the identification device through the ink ribbon in FIG. 4.

Please refer to FIG. 4A. FIG. 4A shows position signals 78 generated by the identification device 68 when winding the ink ribbon 42. In this embodiment, the light source 62 is a yellow light source 62, and the greatest signal gain of the optical sensor 64 occurs when responding to red light. When the yellow light beam 66 passes through the yellow color frame 46, the red and green components of the yellow light beam 66 will both penetrate through the color frame 46, thus the optical sensor 64 will generate a high output voltage such as 4.7 V. When the yellow light beam 66 passes through the magenta color frame 48, the red component of the yellow light beam 66 will penetrate through the color frame 48 but the green component is blocked, thus the optical sensor 64 will generate a moderate level output voltage such as 2.7 V. When the yellow light beam 66 passes through the cyan color frame 50, the green component will penetrate through the color frame 50 but the red component will not, thus the optical sensor 64 will only generate a low output voltage such as 1.7 V. The opaque area 52 is installed for indicating to the identification device 68 that the ink ribbon 42 is at the beginning of a new dye block 44. It is usually black in color to prevent the generation of any output voltages by optical sensor 64. The identification device 68 comprises three comparators 70, 72, 74 with reference potentials of 4.3 V, 2.3 V, 1.0 V respectively. Because the light beam 66 has different penetration rates for the three color frames 46, 48, 50, the three comparators 70, 72, 74 can be used for detecting the four distinct output voltages 76 and generating corresponding position signals 78 for identifying the positions of a dye block 44 of the ink ribbon 42 and the color frames 46, 48, 50 inside the dye block 44.

The opaque area 52 is used for signifying the beginning of a new dye block 44 and need not be black in color. It may be magenta or of any color as long as the position signal generated from it is different from the position signals generated from its adjacent color frames 46, 50. Moreover, the opaque area 52 can be removed if the identification device 68 is modified properly. Furthermore, the yellow light source 62 can be replaced by a green light source 62 for emitting green light.

Please refer to FIG. 4 and FIG. 4B. FIG. 4 is a perspective view of another ink ribbon 80 according to the present invention. FIG. 4B shows position signals 86 generated by the identification device 68 through the ink ribbon 80. The ink ribbons 80 and 42 are different in that a rear end of each dye block 44 of ink ribbon 80 further comprises a transparent color frame 82 stored with a protective material which can be printed onto the printed color picture to generate a protective overlay. When the transparent color frames 46, 48, 50, 82 and the opaque area 52 pass by the optical sensor 64, the optical sensor 64 will generate four different output voltages 84, and the three comparators 70, 72, 74 of the identification device 68 will detect the four different output voltages 84 and generate corresponding position signals 86. Although the output voltages generated by the yellow color frame 46 and the transparent color frame with the protective material 82 are both 4.7 V, the identification device 68 will identify the two color frames 46, 82 as different color frames because they are not installed at adjacent positions. As described beforehand, the black opaque area 52 can be replaced by other colors such as magenta or cyan.

Figure 5:
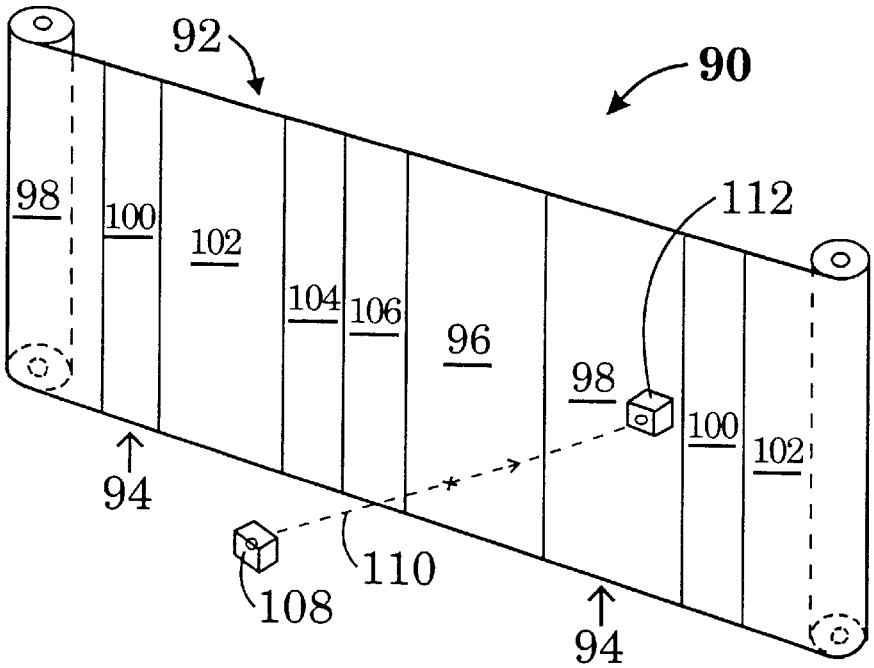
FIG. 5 is a perspective view of an alternative ink ribbon positioning system according to the present invention.

Please refer to FIG. 5. FIG. 5 is a perspective view of an alternative ink ribbon positioning system 90. The ink ribbon positioning system 90 is used for detecting the position of a color ink ribbon 92 of a color printer 91. The ink ribbon 92 is windingly installed inside an ink ribbon box (not shown). The ink ribbon 92 comprises a plurality of dye blocks 94 sequentially installed. Each dye block 94 comprises a predetermined number of transparent color frames 96, 98, 102 arranged sequentially for storing yellow, magenta, and cyan dyes respectively. A front end of each dye block 94 comprises an opaque area 106 with a fixed length for separating neighboring dye blocks 94. A rear end of each dye block 94 comprises a transparent area 104 with a fixed length next to the opaque area 106. The magenta color frame 98 and the cyan color frame 102 are further installed with a transparent area 100 with a fixed length between them.

Figure 6:
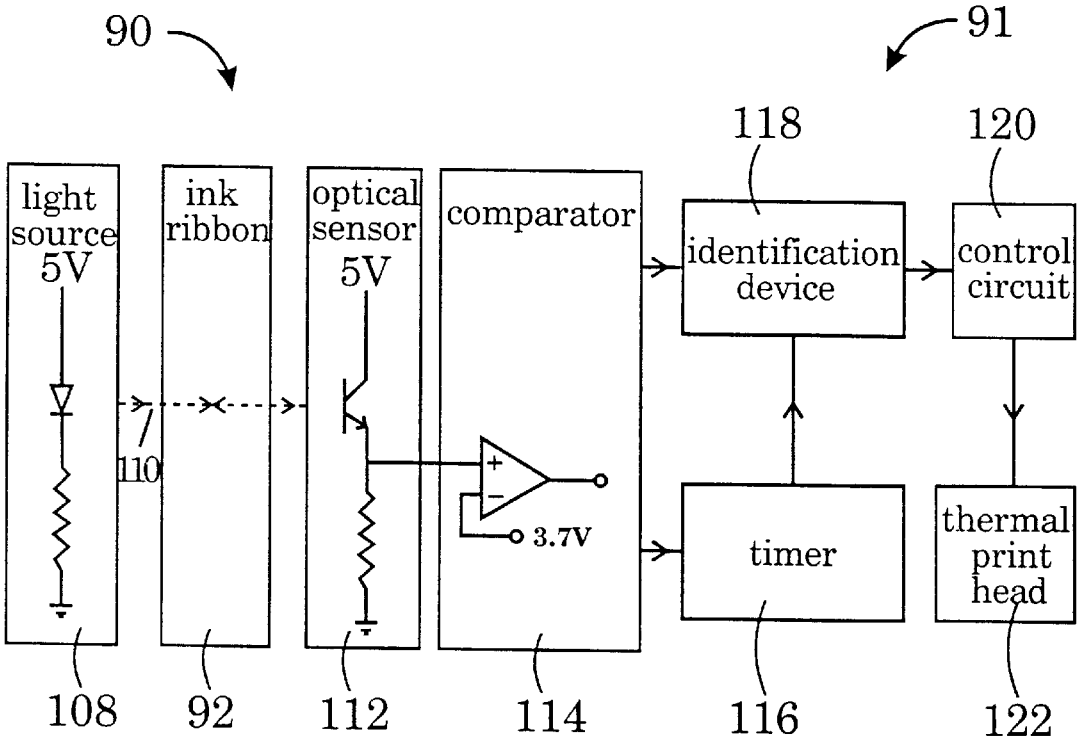
FIG. 6 is a block diagram of the ink ribbon positioning system in FIG. 5.

Please refer to FIG. 6. FIG. 6 is a block diagram of the ink ribbon positioning system 90. The ink ribbon positioning system 90 comprises a light source 108 installed at one side of the ink ribbon 92 for emitting a yellow light beam 110 through the ink ribbon 92, an optical sensor 112 installed at the opposite side of the ink ribbon 92 for detecting the light beam 110 passed through the ink ribbon 92 and generating a corresponding output voltage, a comparator 114 for comparing the output voltage generated by the optical sensor 112 with a 3.7 V reference voltage and generating a corresponding comparison signal 124, a timer 116 which resets its time to zero to count time when the comparison signal 124 is switched and continuously generates a time signal 126, and an identification device 118 for identifying whether the time signal 126 is an "S" signal indicating a short time period or an "L" signal indicating a long time period and for identifying positions of a dye block 94 and color frames inside the dye block 94 according to the comparison signal 124 and the time signal 126 and generating corresponding position signals. The color printer 91 further comprises a control circuit 120 and a thermal print head 122. The control circuit 120 will control the printing of the thermal print head 122 according to the position signals generated by the identification device 118.

Please refer to FIG. 6A. FIG. 6A shows the comparison signals 124 generated by the comparator 114 and the time signals 126 generated by the timer 116 of the ink ribbon positioning system 90. When the opaque area 106 and the color frames of each dye block 94 pass by the optical sensor 112 in sequence at a constant speed, the comparator 114 will compare the output voltage generated by the optical sensor 112 with a 3.7 V reference potential. Each subsequent region will cause the comparator 114 to generate an alternate comparison signal 124 which will trigger the timer 116 to reset its time so as to restart its count from an initial time reference and to generate a new time signal 126. Because the opaque area 106 and the transparent areas 100, 104 have shorter lengths, the timer 116 will generate "S" signals to signify the shorter time periods required for them to pass by the optical sensor 112. The yellow, magenta and cyan color frames 96, 98, 102 have longer lengths so when the timer 116 records a time period longer than that of the "S" signal, the identification device 118 will identify that the optical sensor 112 has detected one of the three color frames 96, 98, 102 and that the time signal generated by the timer 116 is an "L" signal. The identification device 118 identifies the time period required by each region to pass by the optical sensor 112 according to the comparison signal 124 generated by the comparator and the time signal 126 generated by the timer 116. The identification device 118 will also use the time signal pattern formed within each dye block 94 to identify the position of each region and generate corresponding position signals. For example, although the comparison signals 124 and the time signals 126 generated by the magenta and cyan color frames 98, 102 are the same, the transparent area 100 between them will cause the comparison signals 124 to alternate twice over the three regions 98, 100, 102, and thus the identification device 118 can identify each of the color frames 98, 102 and the transparent area 100 according to the comparison signals 124 and time signals 126 generated by them. In the same manner, although the comparison signals 124 generated by the cyan color frame 102 and the opaque area 106 are the same, the transparent area 104 between them will cause the comparison signals 124 to alternate twice over the regions 102, 104, 106 so that the timer 116 will be triggered to count the time required for each of the regions 102, 104, 106 to pass by the optical sensor 112. The identification device 118 then can identify the cyan color frame 102 and opaque area 106 according to their comparison signals 124 and time signals 126.

Please refer to FIG. 6B. FIG. 6B shows the comparison signals 128 and time signals 130 generated by the ink ribbon positioning system 90 through an ink ribbon 92 with protective material. When a rear end of each dye block 94 of the ink ribbon 92 is installed with a transparent color frame 132 with protective material, because the comparison signal 128 generated over the frame 132 is different from the comparison signals 128 generated over the cyan color frame 102 and the opaque area 106, the transparent area 104 can be removed without preventing the identification device 118 from identifying the cyan color frame 102 and the opaque area 106 correctly. As described by the explanation for FIG. 4A, the opaque area 106 is used for signifying the beginning of a new dye block and making position signals generated by adjacent color frames identifiable. Thus, the identification device 68 can be modified to provide an ink ribbon arranged in the manner as shown in FIG. 6C. FIG. 6C shows comparison signals 134 and time signals 136 generated by the ink ribbon modified from the ink ribbon 92. Each dye block 94 comprises transparent color frames 96, 98, 102 for storing yellow, magenta, and cyan dyes. Because the comparison signals 134 and time signals 136 generated by the magenta and cyan color frames 98, 102 are the same, the two color frames 98, 102 have to be separated by a transparent area 100. Furthermore, the opaque area 106 and the transparent area 104 can be removed without preventing the identification device 118 from correctly identifying the color frames.

The embodiments mentioned in this invention only describe cases which the light source and the optical sensor are installed at opposite sides of the ink ribbon. However, the light source and the optical sensor may be installed at the same side if a reflector is installed at the opposite side of the ink ribbon for reflecting the light beam emitted from the light source back to the optical sensor for generating output voltages.

Compared with the prior art ink ribbon positioning system, each of the ink ribbon positioning systems 40, 90 only comprises a light source and an optical sensor. Thus, the number of components of the color printer is reduced and the production cost is lowered.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink ribbon positioning system of a color printer for identifying various positions of a color ink ribbon of the color printer and generating corresponding position signals, the color printer comprising a thermal print head and a control circuit which uses the position signals to control the printing of the thermal print head, the ink ribbon being windingly installed inside an ink ribbon box having a plurality of sequentially arranged dye blocks, each of the dye blocks comprising a predetermined number of sequentially arranged transparent color frames for storing different color dyes; the ink ribbon positioning system comprising:

a light source installed at one side of the ink ribbon for emitting a light beam of a predetermined color through the ink ribbon;

only a single optical sensor for detecting the light beam penetrated through the ink ribbon and generating an output voltage; and an identification device having a plurality of comparators with different predetermined reference voltages respectively, for identifying positions of each of the dye blocks of the ink ribbon and the color frames within each of the dye blocks according to the output voltage generated by the optical sensor and generating corresponding position signals;

wherein the light beam of the predetermined color emitted by the light source has different penetration rates for different color frames of each of the dye blocks, and the output voltage generated by the optical sensor varies when each of the color frames within each of the dye blocks passes by the optical sensor, and wherein the identification device generates said corresponding position signals to identify the position of each of the dye blocks and the position of each of the color frames within each dye block according to the comparison of the output voltage of the optical sensor with the reference voltages of the comparators.

2. The ink ribbon positioning system of claim 1 wherein each of the dye blocks comprises an opaque area over its front and rear ends, and the light beam emitted by the light source has different penetration rates for different color frames and the opaque areas of each of the dye blocks, and the output voltage generated by the optical sensor varies when each of the color frames within each of the dye blocks and the opaque areas pass by the optical sensor, wherein the identification device identifies the position of each of the dye blocks and the position of each of the color frames and the opaque areas within each dye block according to the output voltage of the optical sensor.

3. The ink ribbon positioning system of claim 2 wherein each dye block comprises three transparent color frames of different colors and when the three color frames and the opaque areas pass by the optical sensor, the optical sensor will generate four different output voltages, and wherein the identification device comprises three comparators for identifying the four different output voltages and generating corresponding position signals.

4. The ink ribbon positioning system of claim 3 wherein the opaque area is a black area, and the three transparent color frames are yellow, magenta and cyan color frames.

5. The ink ribbon positioning system of claim 4 wherein the light beam emitted from the light source can be yellow light or green light, and the optical sensor is the most responsive to the red light portion contained in the received light beam when compared with other color lights contained in the received light beam.

6. The ink ribbon positioning system of claim 2 wherein each dye block comprises four transparent color frames of different colors, and when the four color frames and the opaque areas pass by the optical sensor, the optical sensor will generate four different output voltages wherein the identification device comprises three comparators for identifying the four different output voltages and generating corresponding position signals.

7. The ink ribbon positioning system of claim 1 wherein the light source and the optical sensor are installed at opposite sides of the ink ribbon so that the optical sensor can detect the light beam passed through the ink ribbon and generate the output voltage.

8. The ink ribbon positioning system of claim 1 wherein the light source and the optical sensor are installed at one side of the ink ribbon, and a reflector is installed at another side of the ink ribbon so that the light beam emitted from the light source will be reflected back to the optical sensor by the reflector.

9. An ink ribbon positioning system of a color printer for identifying various positions of a color ink ribbon of the color printer and generating corresponding position signals, the color printer comprising a thermal print head and a control circuit which uses the position signals to control the printing of the thermal print head, the ink ribbon being windingly installed inside an ink ribbon box having a plurality of sequentially arranged dye blocks, each of the dye blocks comprising a predetermined number of sequentially arranged transparent color frames for storing different color dyes, each of the color frames of one dye block defining a region; the ink ribbon positioning system comprising:

a light source installed at one side of the ink ribbon for emitting a light beam of a predetermined color toward the ink ribbon;

an optical sensor for detecting the light beam penetrated through the ink ribbon and generating a corresponding output voltage;

a comparator for comparing the output voltage generated by the optical sensor with a reference voltage and generating a corresponding comparison signal;

a timer for generating a time signal for indicating the length of a time period required for the region to pass by the optical sensor, time periods of all regions within one dye block forming a time period pattern; and an identification device for identifying positions of each of the dye blocks of the ink ribbon and the color frames within each of the dye blocks according to the comparison signal, the time signal and the time period pattern, and generating corresponding position signals for the control circuit to control the printing of the thermal print head.

10. The ink ribbon positioning system of claim 9 wherein each of the dye blocks comprises an opaque area of a fixed length over its front and rear ends and each of the opaque areas of one dye block also defines a region, and when each of the regions of one dye block passsby the optical sensor sequentially, each pair of adjacent regions will cause the comparator to generate different comparison signals, and wherein the identification device will identify the position of each of the regions within one dye block according to the comparison signal, the time signal and the time period pattern formed by the time periods of all the regions within one dye block, and generate corresponding position signals for each of the regions.

11. The ink ribbon positioning system of claim 10 wherein each dye block further comprises a predetermined number of transparent areas of a fixed length installed between neighboring regions of each dye block so that when the regions and the transparent areas of each dye block pass by the optical sensor in sequence, each pair of adjacent regions or adjacent region and transparent area will cause the comparator to generate different comparison signals.

12. The ink ribbon positioning system of claim 11 wherein the opaque area is a black area, each dye block comprises yellow, magenta and cyan color frames and a transparent color frame stored with protective material.

13. The ink ribbon positioning system of claim 12 wherein the light beam emitted from the light source can be yellow light or green light, and the optical sensor is the most responsive to the red light portion contained in the received light beam when compared with other color lights contained in the received light beam.

14. The ink ribbon positioning system of claim 9 wherein the light source and the optical sensor are installed at opposite sides of the ink ribbon so that the optical sensor can detect the light beam passed through the ink ribbon and generate the output voltage.

15. The ink ribbon positioning system of claim 9 wherein the light source and the optical sensor are installed at one side of the ink ribbon, and a reflector is installed at another side of the ink ribbon so that the light beam emitted from the light source will be reflected back to the optical sensor by the reflector.

16. An ink ribbon positioning system of a color printer for identifying various positions of a color ink ribbon of the color printer and generating corresponding position signals, the color printer comprising a thermal print head and a control circuit which uses the position signals to control the printing of the thermal print head, the ink ribbon being windingly installed inside an ink ribbon box having a plurality of sequentially arranged dye blocks, each of the dye blocks comprising a first color frame, a second color frame, and a third color frame; the ink ribbon positioning system comprising:

a light source installed at one side of the ink ribbon for emitting a light beam of a predetermined color through the ink ribbon, said predetermined color light including a first color component and a second color component;

only a single optical sensor for detecting the light beam penetrated through the ink ribbon and generating an output voltage, said optical sensor having a greater signal gain responsive to the first color component that to the second color component; and an identification device for identifying positions of each of the dye blocks of the ink ribbon and the color frames within each of the dye blocks according to the output voltage generated by the optical sensor and generating corresponding position signals;

wherein the transmission rate of the first color component for the second color frame is greater than the transmission rate of the second color component for the second color frame, the transmission rate of the second color component for the third color frame is greater than the transmission rate of the first color component for the third color frame, and the output voltage generated by the optical sensor varies at three different values when each of the color frames within each of the dye blocks passes by the optical sensor respectively, and wherein the identification device generates three different signals to identify the position of each of the dye blocks and the position of each of the color frames within each dye block according to the output voltage of the optical sensor.

17. The ink ribbon positioning system of claim 16 wherein each of the dye blocks comprises an opaque area over its front and rear ends, and both said first color component and said second color component can not transmit the opaque areas of each of the dye blocks, and the output voltage generated by the optical sensor varies to a fourth value when the opaque areas pass by the optical sensor, wherein the identification device generates a fourth signal to identify the position of the opaque areas within each dye block when the output voltage of the optical sensor is the fourth value.

18. The ink ribbon positioning system of claim 16 wherein the light beam emitted from the light source is yellow light which includes a red light component and a green light component, and the optical sensor has greater signal gain responsive to the red light component than to the green light component.

* * * * *